United States Patent [19]

Le Duc

[11] Patent Number: 4,890,519

[45] Date of Patent: Jan. 2, 1990

[54] ADJUSTABLE PLIERS

[76] Inventor: Don Le Duc, 2405 Alvarado Dr., Santa Clara, Calif. 95051

[21] Appl. No.: 239,949

[22] Filed: Sep. 2, 1988

[51] Int. Cl.[4] ..... B25B 7/14

[52] U.S. Cl. ..... 81/328; 81/414

[58] Field of Search ..... 81/328, 325, 326, 327, 81/414, 392, 393, 352, 330, 418, 424

[56] References Cited

U.S. PATENT DOCUMENTS

| | | | |
|---|---|---|---|
| 676,730 | 6/1801 | Wilson | 81/392 |
| 1,125,945 | 1/1915 | Boling et al. | 81/393 |
| 1,950,362 | 3/1934 | Manning | 81/414 |
| 2,341,489 | 2/1944 | Tornborg | 81/392 |
| 2,592,927 | 4/1952 | Manning | 81/414 |
| 2,640,381 | 6/1953 | Manning | 81/414 |
| 3,192,805 | 7/1965 | Manning | 81/414 |

FOREIGN PATENT DOCUMENTS

| | | | |
|---|---|---|---|
| 0311352 | 4/1918 | Fed. Rep. of Germany | 81/414 |

OTHER PUBLICATIONS

*Machine Design,* Jan. 9, 1986, p. 55, Stock Drive Products.

*Primary Examiner*—Frederick R. Schmidt
*Assistant Examiner*—Lawrence Cruz

[57] ABSTRACT

Adjustable pliers of the tongue and groove jaw adjustment type in which the pivot pin carries and slides one member along a tracking section of an intermediate portion of the other member in an interlocking but free sliding manner and in which the pivot pin has been placed closer to the work center of the plier jaws for increased leverage of the tool.

2 Claims, 1 Drawing Sheet

ADJUSTABLE PLIERS

FIELD OF THE INVENTION AND RELATED ART STATEMENT

The present invention relates to tongue and groove type jaw adjustment pliers which were established by U.S. Pat. No. 1,950,362. The method used therein relieved the pivot pin from severe shear and bending loads. The next weak point of the pliers was found to be in the tension edge adjacent and parallel to the adjustment slot of one plier member. This problem was solved by U.S. Pat. No. 2,592,927 which added a reinforcing rib to the tension edge in a precise technical manner.

The pivot, to a lesser degree, was still subjected to side loads because the tongue and grooves were not of a positive interlocking profile. Machining these features was set by U.S. Pat. No. 2,640,381 and further refined by U.S. Pat. No. 3,192,805 by all the same company.

Eight years later a new forging technique was discovered and set with U.S. Pat. No. 3,739,664 which introduced the method of inverse draft forging that did away with the need for after-machining that is expensive and that introduces additional weak points in the parts. The method teaches the correct placement of the parting lines in the parts to be forged.

The prior art makes my tool manufacturable in a cost effective manner and safe-guards my new pivot pin from undesireable outside forces. A longitudinal reinforcing rib in my design would have been cut away in the old method.

OBJECT AND SUMMARY OF THE INVENTION

The main object of my invention is to provide adjustable pliers of the type described before, which are assembled faster and easier because of the improved pivot pin design which is of a single unit nature. The conventional pivot pin assembly consists of a bolt and nut which are staked together at the last point of assembly. The staking method has for all times failed to be reliable and has created a dislike for such tools.

Also over- or understaking by the assembly person causes plier handles to be either too tightly packed or too loose. For a longer life of the tool it is better that the tool is assembled with the least of clearance left, but will cause binding at some points of the adjustment range. Some companies have resorted to factory greasing to remedy their problem.

My pivot pin will fit at all times because no human judgement is involved.

The other object achieved is to have eliminated the adjustment slot that weakened the slotted plier member and the supporting arcuate ribs, which were nearly cut in half by the width of the slot. By deleting the slot, those ribs can now be made shorter and as a result readjustments are made sooner due to the shorter arc lengths involved. The pivot pin has been brought closer to the work center of the plier jaws, which means an increase in the leverage of the tool. It now makes for good sense to add a swivel jaw to one of the jaws so that regular shaped objects, such as nuts and bolts, may be turned, held or clamped without marring those items. A swivel jaw has not been used in pliers of this type before so that they limited themselves in their usefulness.

Instead of reaching for an adjustable wrench to perform any odd job, these pliers are capable of doing it.

The added advantage of the tool is it's built-in ratcheting ability to speed up the work.

The forces exerted by the jaws are distributed over the jaws equally, so that no damage will be done to plated plumbing fittings or other objects.

With the increased leverage and the parallel jaws, this tool qualifies to be called wrench-pliers, in the trade.

DESCRIPTION OF THE PREFERRED EMBODIMENT

Figure 2:
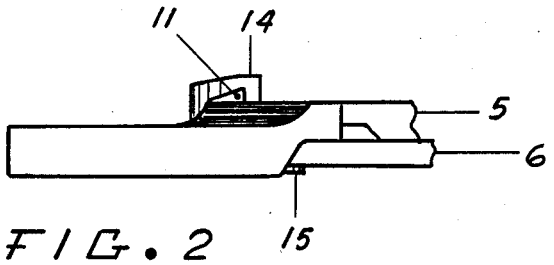
FIG. 2 is a top elevation of FIG. 1.

The tool comprises pivoted members 1 and 2 provided with jaws 3 and 4 respectively at one side of a pivot pin 14 extending through a bore in the member 2. Pin 14 is slidably engaged with member 1.

On the opposite side of the pivot pin, the members 1 and 2 are provided with handles 5 and 6 respectively.

Set off at an angle to jaw 3 is an intermediate portion 7, the width of which is defined by a forward edge 8 and a rear edge 9. This intermediate portion is recessed to form a plurality of substantially short ribs **10*a* and a stiffener rib 9*a* which extends into jaw 3 and into the handle member 5. Rib 9*a* comes to the same elevation as that of ribs 10*a* and provides a sliding surface for the pivoting member 2 and blocks off any side loading on the pin for at least in one direction. Ribs 10*a* define complementary arcuate grooves 10 which will not be present in the lowest rib portion 10*c*** because locking connections are not made therein.

The ends of ribs **10*a* form short vertical walls 10*b* which are in line with the vertical wall of the lower rib portion 10*c* and are in parallel relationship with forward edge 8. The sum of those walls provide a sliding edge for the pivot pin while retaining it on member 1**.

Figure 3:
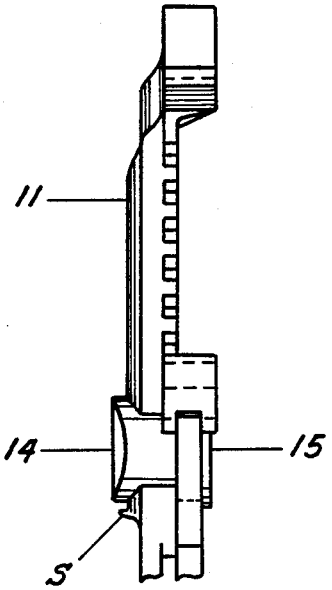
FIG. 3 is a front elevation of FIG. 1.
Figure 1:
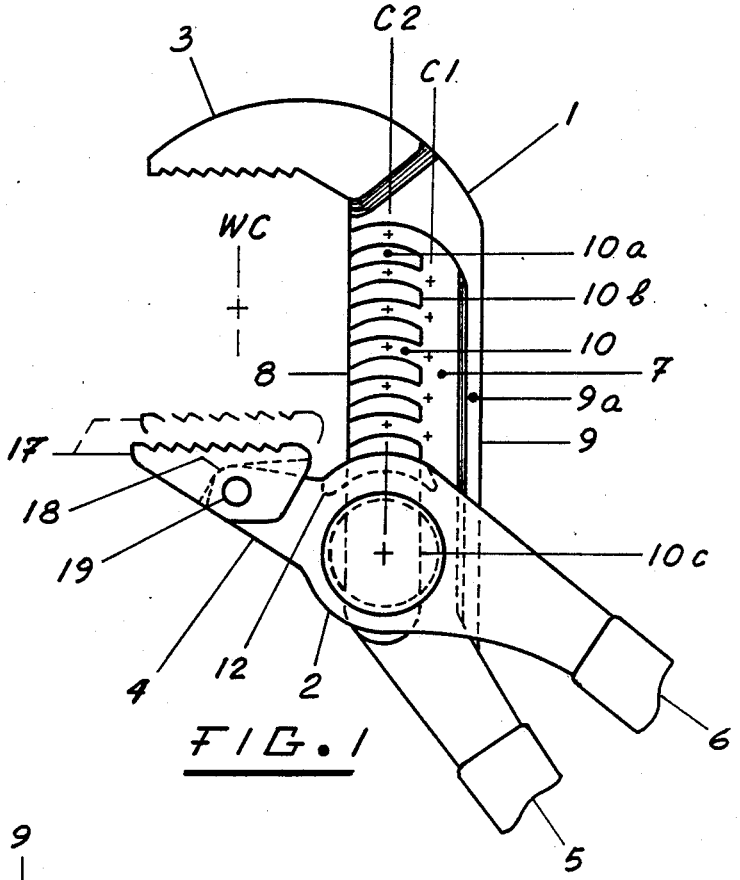
FIG. 1 is a side elevation of the tool.
Figure 4:
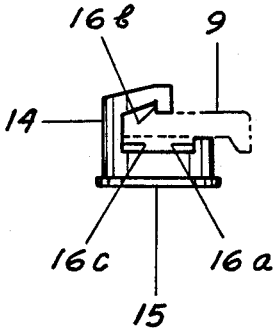
FIG. 4 is a detail of the pivot pin.
Figure 5:
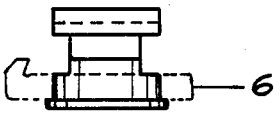
FIG. 5 is a side elevation of FIG. 4.

Another retaining or tracking edge 11 is formed on the opposite side of the recessed surface of the intermediate portion of member 1 and runs for the greatest length of that portion, parallel to forward edge 8. This hook-like tracking edge shows in FIGS. 2 and 3.

On the member 2 is an arcuate rib 12 receivable in any one of the plurality of complementary grooves 10.

Radial rib 12 is centered to the pivot pin 14 which has a round and thin head 15.

The round shank of the pin is large in diameter and is opened transversely to a hole with an outline that is complementary to the cross section of the intermediate portion 7 of member 1. Hook-like edges **16*a* and 16*b* slide against the tracking edges on member 1 and surface 16*c* slides against forward edge 8. Edge 16*b* cooperates with tracking edge 11 and 16*a* slides along the vertical walls of all the ribs on member 1**.

The range of opening between jaws 3 and 4 is adjusted by sliding the member 2 along the forward edge 8 and the tracking edges **10*b*, *c* and 11**.

The new center line of the pivot pin C2 has moved closer to the work center of the tool WC, the old center line was located at C1.

In the old method of after-machining rib **9*a* would have been cut up by the circular saw that provided negative rakes to the arcuate ribs. The new method of inverse drafting avoids this. Jaw 4 is shown furnished with a swivel jaw 17 which terminates into a roundedoff end 18 with a hole drilled through it. The swivel jaw is bifurcated to straddle end 18 and is installed by pin 19** which may be a spring-pin that floats in the hole of the jaw but is press-fitted into the sides of the swivel jaw.

The two jaws are in steel to steel contact with each other and no loading is put on the pin, which makes it possible to design for a rather small in diameter pin.

Having fully described the invention, what I claim as new and desire to secure by Letters Patent of the United States is:

1. In pliers having a pair of crossed members and a pivotal joint between the members one first member comprising a handle having a top end thereof formed into an intermediate portion that terminates into a first jaw constructed at substantially right angles thereto;

a second member having a handle, an intermediate portion with a bore therethrough, an arcuate rib radial to said bore and a second jaw extended from said intermediate portion opposite the handle;

said pivotal joint being a pin extending laterally through the bore in said second member and having a circular head concentric to a shank, said shank having an opening transverse to the axis of the pin to a hole with an outline complementary to the cross section of the intermediate portion of the first member to provide a tracking connection that prevents lateral shifting of one member relative to the other in a direction crosswise of the intermediate portion but allowing unrestricted sliding lengthwise of the first member;

said first member having a plurality of arcuate ribs of equal lengths with in line vertical walls at the ends of said ribs defining a plurality of spaced grooves projected on one side of the intermediate portion of the first member and receiving the rib on the pin carrying member, a non-grooved portion between the handle and the arcuate ribs that is formed to the same elevation of said ribs with a width that equals the lengths of said ribs and having a vertical side wall in-line with the vertical walls of said ribs;

a tracking geometry on the intermediate portion of the first member being defined by three tracking edges, the first tracking edge being the edge of the intermediate portion from which the first jaw projects at substantially right angles thereto, the second tracking edge created by the vertical walls of the arcuate ribs and the vertical wall of said non-grooved portion, the third tracking edge comprising the side of the intermediate portion opposite the ribbed side, the second and third tracking edges directed parallel to the first edge.

2. Pliers as in claim 1 wherein said third edge is formed into a longitudinal rib, the elevation of which matches that of the arcuate ribs on said intermediate portion of side support of the second member and for adding strength to said first intermediate portion.

* * * * *